US011591781B2

(12) United States Patent
Maruyama et al.

(10) Patent No.: US 11,591,781 B2
(45) Date of Patent: Feb. 28, 2023

(54) FLUSH TOILET

(71) Applicant: TOTO LTD., Kitakyushu (JP)

(72) Inventors: Takahiro Maruyama, Kitakyushu (JP); Wataru Ishimi, Kitakyushu (JP); Seiya Nakashima, Kitakyushu (JP)

(73) Assignee: Toto Ltd., Fukuoka (JP)

( * ) Notice: Subject to any disclaimer, the term of this patent is extended or adjusted under 35 U.S.C. 154(b) by 0 days.

(21) Appl. No.: 17/679,660

(22) Filed: Feb. 24, 2022

(65) Prior Publication Data

US 2022/0275616 A1 Sep. 1, 2022

(30) Foreign Application Priority Data

Feb. 26, 2021 (JP) ..... JP2021-030144

(51) Int. Cl.

| | |
|---|---|
| ***E03D 1/26*** | (2006.01) |
| ***E03D 11/06*** | (2006.01) |
| ***E03D 1/012*** | (2006.01) |
| ***E03D 5/01*** | (2006.01) |

(52) U.S. Cl.

CPC ..... *E03D 1/26* (2013.01); *E03D 1/012* (2013.01); *E03D 11/06* (2013.01); *E03D 5/01* (2013.01)

(58) Field of Classification Search

CPC .. E03D 1/01; E03D 1/012; E03D 1/26; E03D 11/06; E03D 5/01

USPC ..... 4/420, 431, 432

See application file for complete search history.

(56) References Cited

FOREIGN PATENT DOCUMENTS

| | | | |
|---|---|---|---|
| CN | 108755880 A | * | 11/2018 |
| JP | 2014-114633 A | | 6/2014 |
| JP | 2017-89282 A | | 5/2017 |
| JP | 2020-169538 A | | 10/2020 |

* cited by examiner

*Primary Examiner* — Tuan N Nguyen
(74) *Attorney, Agent, or Firm* — BakerHostetler

(57) ABSTRACT

A flush toilet includes a toilet main body made of ceramics and a control unit. The toilet main body includes a skirt, and a rear storage that can store at least a part of the control unit, the rear storage includes a supporting wall that divides a storage region into upper and lower regions and that supports the control unit, the skirt forms a double wall including an outer wall and an inner wall, the double wall has at least a part that forms an internal space between the outer wall and the inner wall, and the skirt includes a single wall in which the internal space of the double wall is removed in an upper end above a joining portion between the double wall and the supporting wall.

5 Claims, 7 Drawing Sheets

FLUSH TOILET

CROSS REFERENCE TO RELATED APPLICATION

This application claims benefit of priority to Japanese Patent Application No. 2021-030144, filed on Feb. 26, 2021, the entire content of which is incorporated herein by reference.

FIELD OF THE INVENTION

The present invention relates to a flush toilet, and more particularly, to a flush toilet which is flushed with flush water to discharge waste.

BACKGROUND OF THE INVENTION

Conventionally, as a flush toilet which is flushed with flush water to discharge waste, there is known, for example, as described in Patent Document 1 (Japanese Patent Laid-Open No. 2017-89282), Patent Document 2 (Japanese Patent Laid-Open No. 2020-169538) and Patent Document 3 (Japanese Patent Laid-Open No. 2014-114633), a so-called "full skirt" or "total Hakama" flush toilet in which a skirt formed on an outer side than a side surface of each of a bowl of a toilet main body made of ceramics and a water discharge trap is formed all around the toilet main body. In this conventional "full skirt" or "total Hakama" flush toilet, a storage region that can store a control unit including a function of controlling the spout water to the bowl of the toilet main body is provided in a region more rearward than the bowl of the toilet main body.

Further, in a conventional flush toilet described in Patent Document 1, a side wall of a skirt forms a double wall including an outer wall forming an outer surface, and an inner wall provided inside this outer wall. The side wall of the skirt has a structure of the double wall, forms an internal space between the outer wall and the inner wall in the double wall and is joined to a supporting wall that supports the control unit in a storage region of the control unit of the toilet main body. Next, in a conventional flush toilet described in Patent Document 2, a side wall of a skirt that forms a storage region of a control unit more rearward than a bowl of a toilet main body forms a double wall including an outer wall forming an outer surface, and an inner wall provided inside this outer wall, and the side wall forms an internal space between the outer wall and the inner wall. Also, in a part above the double wall of the skirt, a single wall is made in which the internal space between the inner wall and the outer wall is removed. Furthermore, in a conventional flush toilet described in Patent Document 3, a supporting wall provided in a storage region of a control unit of a toilet main body extends in a horizontal direction from a joining portion to a water discharge trap to skirts on opposite left and right sides. Opposite left and right ends of this supporting wall are joined to single walls of side walls of the left and right skirts, respectively, and in the side wall of the skirt below the joining portion, a double wall is formed. That is, the opposite left and right ends of the supporting wall are supported by the single wall above the joining portion to the skirt, and are also supported by the double wall below the joining portion to the skirt.

On the other hand, one of aims that have been requested to be achieved in recent years with design diversification of the flush toilet and improvement in design such as appearance of the flush toilet is to acquire a large storage region that stores a control unit in a region more rearward than a bowl of a toilet main body, while reducing (slimming) an external dimension of the whole toilet main body. For example, in the conventional flush toilet described in Patent Document 1, the double wall of the side wall of the skirt is joined to the supporting wall of the storage region of the control unit, and hence a storage section with a sufficient strength to withstand a weight of the control unit can be acquired. However, there is a problem that a structure of the side wall of the skirt with a thickness of the double wall in an entire region from a lower end to an upper end reduces and narrows the storage region of the control unit. Furthermore, in the conventional flush toilet described in Patent Document 2, there is a problem that the supporting wall of the storage region of the control unit in the toilet main body is not attached to the double wall of the side wall of the skirt, and deformation such as distortion of the supporting wall that supports the control unit might be likely to occur due to insufficient strength. Additionally, in the conventional flush toilet described in Patent Document 3, a region of the skirt below the joining portion between the supporting wall provided in the storage region of the control unit and each of the left and right side walls of the skirt is a double wall, and a region of the skirt above the joining portion between the supporting wall and each of the left and right side walls of the skirt is a single wall. Consequently, there is a problem that the storage region of the control unit cannot be acquired in a region below the horizontal supporting wall and is integrated in the region above the horizontal supporting wall, and hence it is difficult to acquire a large storage region of the control unit in each of the regions below and above the wall part. Also, the storage region integrated in the region above the supporting wall is surrounded with the single wall of the side wall of the skirt and might lack strength depending on a weight of the control unit stored in a storage part, and there is a problem that deformation such as distortion of the supporting wall or the skirt affects an appearance shape or the like of the toilet main body.

Accordingly, the present invention is aimed at solving problems of the conventional arts described above and is aimed at providing a flush toilet in which a large storage region of a control unit in a toilet main body can be acquired, and strength of the whole toilet main body can be increased, while suppressing an external dimension of the whole toilet main body.

SUMMARY OF THE INVENTION

To solve the problems described above, an aspect of the present invention is a flush toilet comprising: a toilet main body made of ceramics, the toilet main body including a bowl configured to receive waste, and a water discharge trap configured to discharge waste in the bowl, the water discharge trap including an inlet connected to a lower portion of the bowl, and a control unit provided more rearward than the bowl of the toilet main body, the control unit being configured to control discharge and stopping of flush water to the bowl, wherein the toilet main body further includes a skirt and a rear storage configured to store at least a part of the control unit, the skirt being formed on an outer side of side surfaces of the bowl and the water discharge trap, and a rear storage being provided below an upper end of the skirt and on an inner side than the skirt in a region more rearward than the bowl, the rear storage includes a supporting wall configured to support the control unit so as to divide a storage region into upper and lower regions, the skirt forms a double wall including an outer wall and an inner wall, the outer wall forms an outer surface, the inner wall is provided inside the outer wall, and at least a part of the double wall forms an internal space between the outer wall and the inner wall, the supporting wall is supported by being joined to the double wall of the skirt, and the skirt includes a single wall in which the internal space of the double wall is removed in an upper end above a joining portion between the double wall and the supporting wall. According to the aspect of the present invention having such a configuration as described above, the supporting wall that divides the storage region of the rear storage into the upper and lower regions and that supports the control unit is joined to and supported by the double wall of the skirt, so that the supporting wall and the skirt can improve strength each other. Also, in the skirt, the upper end above the joining portion between the double wall and the supporting wall includes the single wall in which the internal space of the double wall is removed, and hence a larger storage region in the rear storage can be acquired, while maintaining the strength of the rear storage from the joining portion between the double wall in the skirt and the supporting wall to the upper end above the joining portion. Therefore, the large storage region of the control unit in the toilet main body can be acquired, and the strength of the whole toilet main body can be increased, while suppressing an external dimension of the whole toilet main body.

In the aspect of the present invention, preferably, the skirt includes a first skirt formed by the double wall from a lower end to an upper end of the skirt, and a second skirt formed by the double wall from the lower end of the skirt to a predetermined upper position, the second skirt being formed by the single wall from the predetermined upper position to the upper end of the skirt. According to the aspect of the present invention having such a configuration as described above, for example, when an entire region above the joining portion between the skirt and the supporting wall is set to the single wall, a larger storage region in the rear storage can be acquired, but there is a problem that deformation such as distortion of a part of the single wall or the like of the skirt is likely to occur due to insufficient strength during manufacturing. Consequently, in the aspect of the present invention, the deformation, such as the distortion, of the double wall or the single wall of the skirt during manufacturing can be inhibited by combining the first skirt that is formed by the double wall from the lower end to the upper end of the skirt and the second skirt that is formed by the double wall from the lower end of the skirt to the predetermined upper position and that is formed by the single wall from the predetermined upper position to the upper end of the skirt, and a larger storage region in the rear storage can be acquired while eliminating lack of strength.

In the aspect of the present invention, preferably, the first skirt is provided in a joining portion where the bowl of the toilet main body and the rear storage are joined. According to the aspect of the present invention having such a configuration as described above, generally, the joining portion where the bowl of the toilet main body made of ceramic and the rear storage are joined is a portion to which load such as stress concentration is likely to be applied due to a weight of the bowl itself, a weight of the control unit stored in the rear storage or the like. Therefore, also during manufacturing, transport, or the like of the toilet main body, when load such as internal force or external force to the toilet main body acts on the joining portion between the bowl and the rear storage, the toilet main body might be damaged. To solve the problem, in the aspect of the present invention, the first skirt that is formed by the double wall from the lower end to the upper end of the skirt is joined to the joining portion between the bowl of the toilet main body and the rear storage, so that strength of the joining portion between the bowl and the rear storage can be increased by the double wall of the first skirt. Therefore, also in the rear storage, the larger storage region can be acquired, while eliminating lack of strength.

In the aspect of the present invention, preferably, the rear storage includes: a front region including the joining portion between the bowl of the toilet main body and the rear storage, and a joining portion between the water discharge trap and the supporting wall, the front region being disposed more forward than a discharge core that is a center of an outlet side conduit of the water discharge trap, and a rear region disposed on a rear side of the front region, the double wall of the first skirt is provided in the front region of the rear storage, and the single wall of the second skirt is provided in the rear region of the rear storage. According to the aspect of the present invention having such a configuration as described above, the double wall of the first skirt is provided in the front region of the rear storage including the joining portion between the bowl of the toilet main body and the rear storage, and the joining portion between the water discharge trap and the supporting wall, the front region being disposed more forward than the discharge core that is the center of the outlet side conduit of the water discharge trap, so that the double wall of the first skirt can support the joining portion between the bowl and the front region of the rear storage, and the double wall of the first skirt can also support the supporting wall that supports the water discharge trap. Therefore, the double wall can increase strength of the first skirt itself in the front region of the rear storage, and a supporting force of the first skirt that supports the joining portion between the bowl and the rear storage can be reinforced. Also, the strength of the first skirt itself in the front region of the rear storage can be reinforced by the double wall, and hence a supporting force of the first skirt that supports the water discharge trap via the supporting wall can be reinforced. Furthermore, for the first skirt in the front region of the rear storage that includes the joining portion to the bowl and the joining portion between the water discharge trap and the supporting wall, a structure of the double wall can provide a structure that is thicker than a structure of the single wall of the second skirt in the rear region of the rear storage. Consequently, when the toilet main body is moved during transport or during construction, an operator can easily hold a structural portion of the double wall of the first skirt that is thicker than the single wall of the second skirt, so that the single wall of the second skirt having lower strength than the structural portion of the double wall of the first skirt can be inhibited from being held.

In the aspect of the present invention, preferably, the double wall of the first skirt slopes at a substantially constant slope angle in such a manner that a wall surface of the inner wall of the double wall spreads outward from below toward above the rear storage, and the second skirt slopes in two stages in such a manner that the wall surface of the inner wall of the double wall of the second skirt spreads outward from bottom to top. According to the aspect of the present invention having such a configuration as described above, the first skirt slopes at the substantially constant slope angle in such a manner that the wall surface of the inner wall of the double wall spreads outward from below toward above the rear storage, so that deformation such as distortion can be unlikely to occur. Furthermore, the second skirt slopes in two stages in such a manner that the wall surface of the inner wall of the double wall of the second skirt spreads outward from bottom toward top, so that a larger storage region in the rear storage can be acquired. Additionally, the wall surface with the constant slope angle in the inner wall of the double wall of the first skirt and the wall surface sloping in two stages in the inner wall of the double wall of the second skirt can increase a difference in thickness between a structural portion of the double wall of the first skirt and a structural portion of the single wall of the second skirt. Therefore, when moving the toilet main body during transport or during construction, the operator can easily hold the structural portion of the double wall of the first skirt that is thicker than the single wall of the second skirt, so that the single wall of the second skirt having a lower strength than the structural portion of the double wall of the first skirt can be inhibited from being held.

In the aspect of the present invention, preferably, the second skirt slopes at a first slope angle in a first slope stage, the first slope angle being identical to the slope angle of the inner wall of the first skirt in such a manner that the wall surface of the inner wall of the double wall spreads outward from a lower joining portion to the supporting wall toward an upper deflection position, and then the second skirt slopes at a second slope angle in a second slope stage, the second slope angle being larger than the first slope angle to spread outward from the deflection position toward the upper single wall. According to the aspect of the present invention having the above configuration, the second skirt slopes, in the first slope stage, at the first slope angle that is identical to the slope angle of the inner wall of the first skirt in such a manner that the wall surface of the inner wall of the double wall spreads outward from the lower joining portion to the supporting wall toward the upper deflection position, and the slope of the double wall is identical to that of the single wall in the first slope stage. Therefore, in a region of the wall surface of the inner wall of the double wall of the second skirt from the lower joining portion to the supporting wall to the upper deflection position, the wall surfaces of the inner walls of the double walls of the first skirt and the second skirt are formed smoothly without mutual steps. Therefore, also in each of the first skirt and the second skirt in a vicinity of the joining portion to the supporting wall, deformation such as distortion due to the mutual steps is unlikely to occur, and lack of strength in the rear storage can be suppressed. Then, the second skirt slopes, in the second slope stage, at the second slope angle that is larger than the first slope angle to spread outward from the deflection position of the inner wall of the double wall toward the upper single wall, so that the slope of the second skirt at the second slope angle in the second slope stage can be formed in a shape that spreads outward from a base end of the deflection position of the double wall toward the upper single wall. Consequently, the larger storage region in the rear storage can be acquired, while suppressing lack of strength of a transition portion that transits from the double wall to the single wall, in the second slope stage of the second skirt.

According to a flush toilet of an aspect of the present invention, a large storage region of a control unit in a toilet main body can be acquired, and strength of the whole toilet main body can be increased, while suppressing an external dimension of the whole toilet main body.

and

Figure 2:
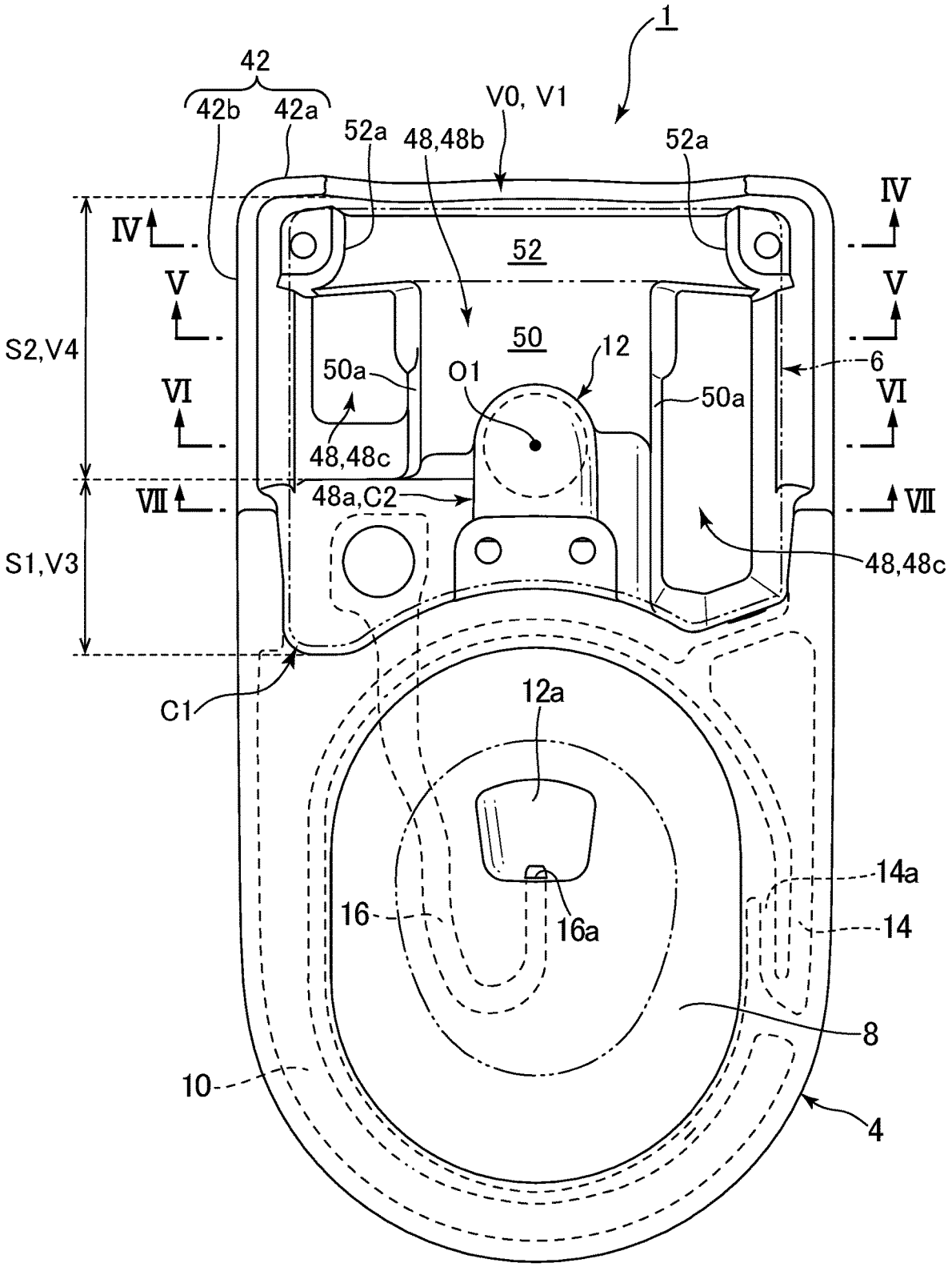
FIG. 2 is a plan view of the flush toilet according to the embodiment of the present invention.
Figure 7:
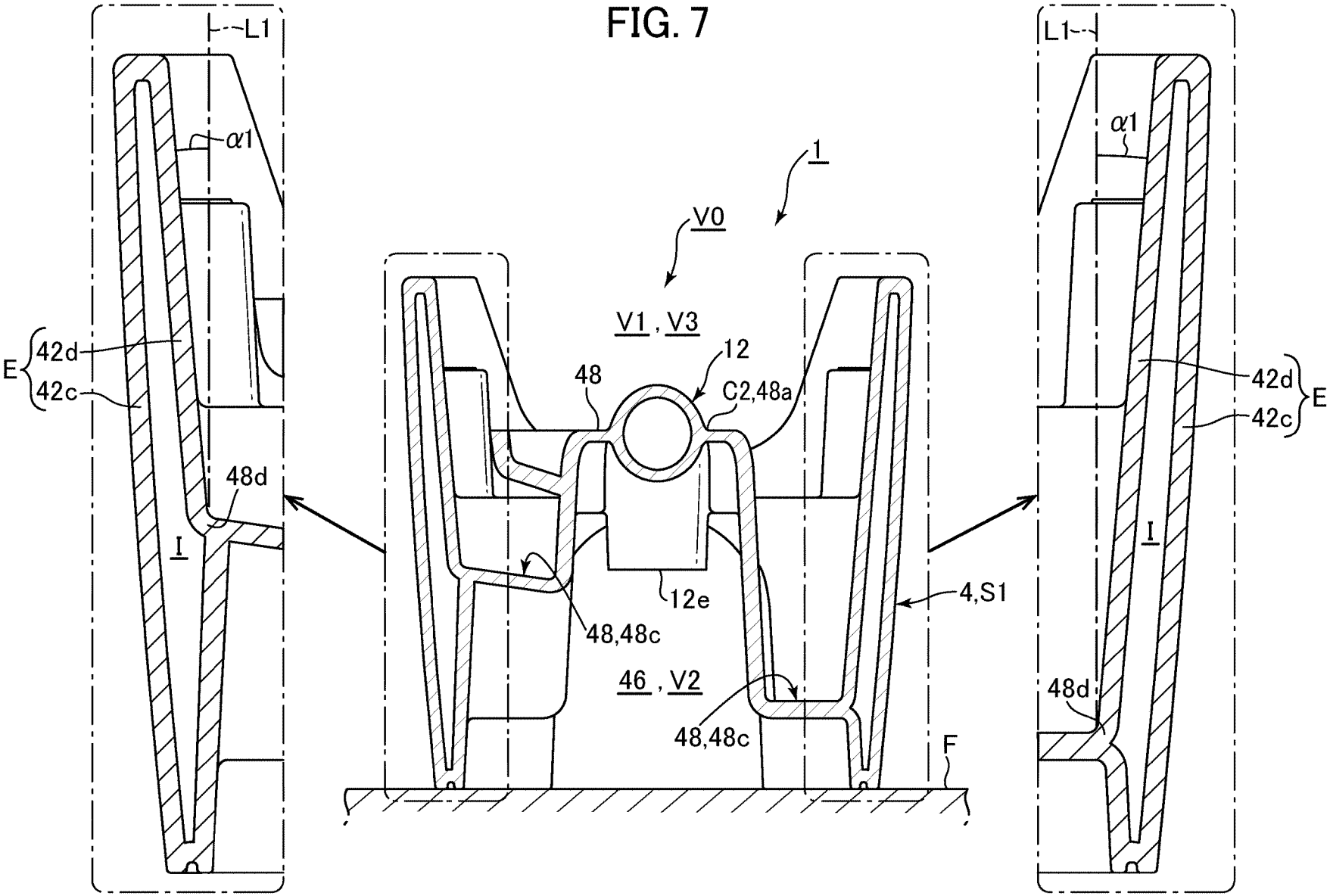

FIG. 7 is a cross-sectional view taken along a line VII-VII of FIG. 2.

DETAILED DESCRIPTION OF THE PREFERRED EMBODIMENT

Figure 1:
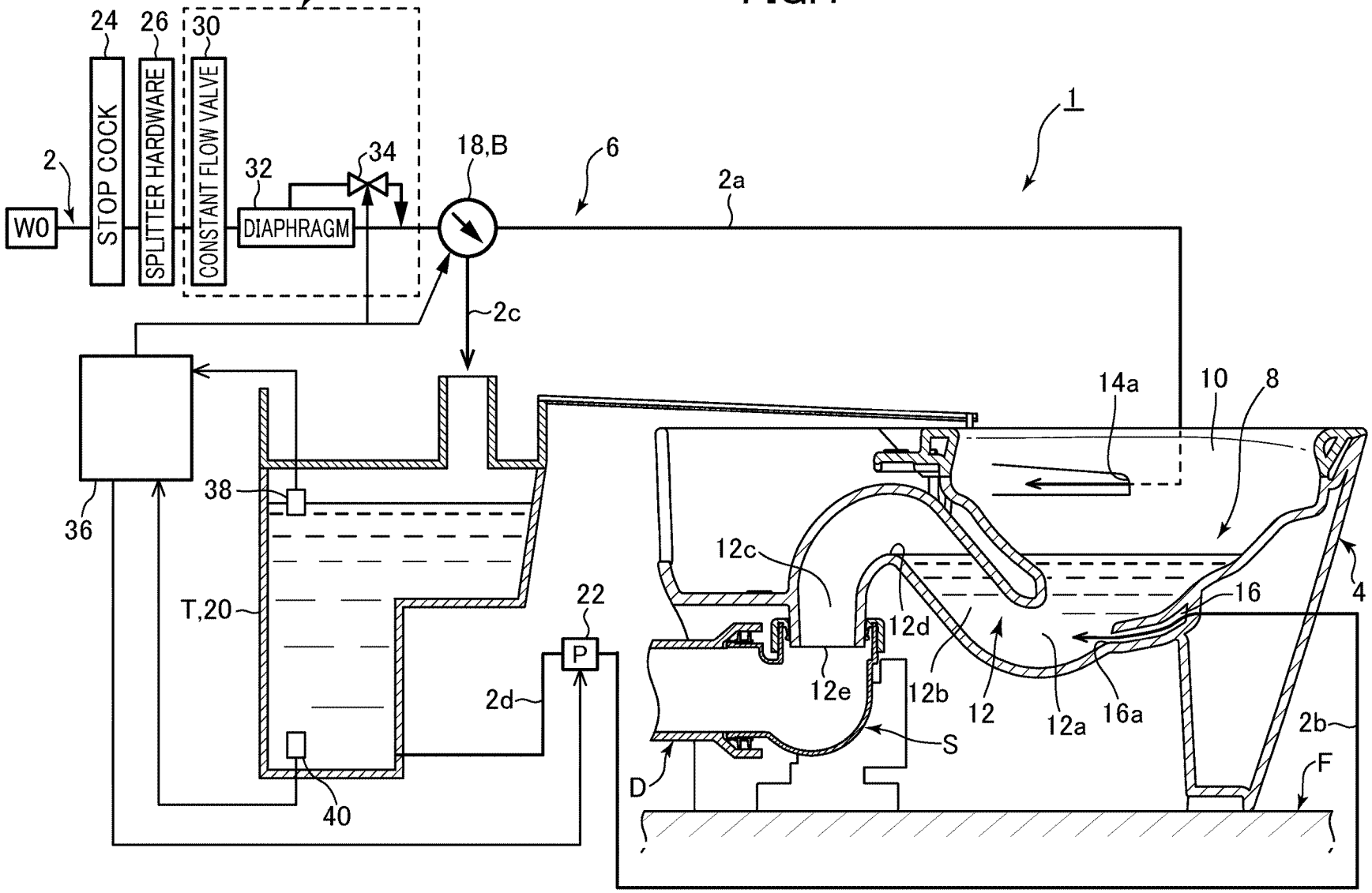
FIG. 1 is an overall structural diagram of a flush toilet according to an embodiment of the present invention.
Figure 3:
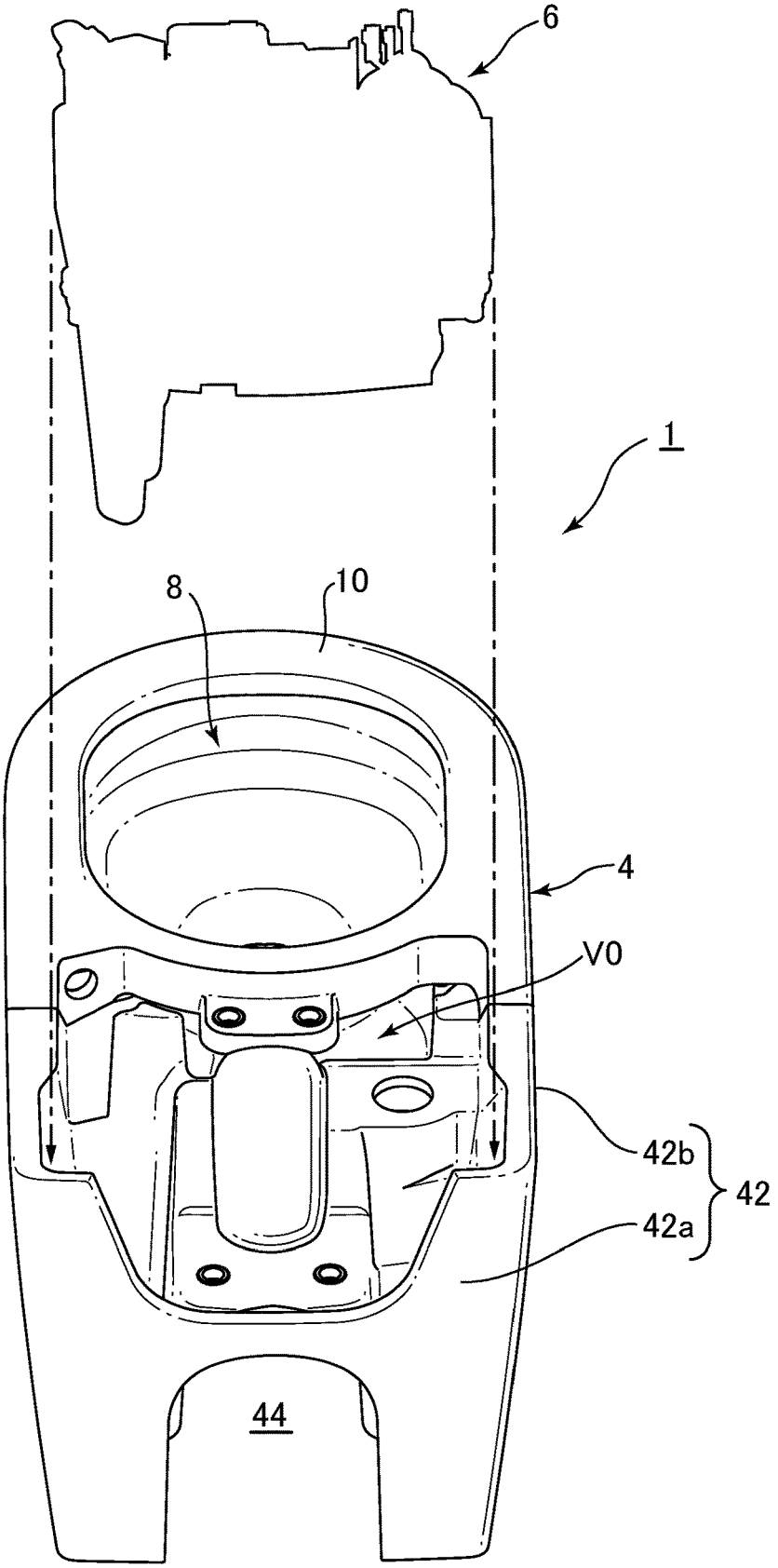
FIG. 3 is an exploded perspective view of the flush toilet according to the embodiment of the present invention seen from rear and diagonally above.

Hereinafter, a flush toilet according to an embodiment of the present invention will be described with reference to the accompanying drawings. First, an entire configuration of the flush toilet according to the embodiment of the present invention will be schematically described with reference to FIGS. 1 to 3. As shown in FIGS. 1 to 3, a flush toilet 1 according to the embodiment of the present invention includes a water supply channel (a main water passageway 2) where flush water that is supplied from a main water supply source WO such as a water system flows through, a toilet main body 4 made of ceramics, and a flush water supply device 6.

Next, as shown in FIGS. 1 to 3, the toilet main body 4 includes a bowl 8 for receiving waste, a rim 10 that is formed at a top edge of the bowl 8, and a water discharge trap 12 extending from a bottom portion of the bowl 8. Furthermore, as shown in FIGS. 1 to 3, although details will be given later, the flush water supply device 6 is a control unit that is provided more rearward than the bowl 8 of the toilet main body 4 and that enables flush water supplied from the main water passageway 2 to be supplied to the toilet main body 4. More specifically, this control unit includes a function of controlling discharge and stopping of flush water to the bowl 8 of the toilet main body 4 by operating on power.

Next, as shown in FIG. 2, a rim conduit 14 is formed in the rim 10 on one of left and right sides of the toilet main body 4 (right side of the toilet main body 4 seen from front). The rim conduit 14 has a so-called U-turn shape that extends forward from the rear side of the toilet main body 4 and then bends rearward, in the rim 10 on one of the left and right sides of the toilet main body 4 (right side of the toilet main body 4 seen from front). Further, a rim spout port 14*a* is provided on a downstream end (downstream rear end) of the rim conduit 14. Furthermore, a rim-side water supply channel 2*a* of the flush water supply device 6, of which more later, is connected on an upstream side of the rim conduit 14 of the toilet main body 4. Flush water that is supplied from the rim-side water supply channel 2*a* to the rim spout port 14*a* is discharged into the bowl 8, rearward from the rim spout port 14*a*, and rim spouting is thus performed.

Next, as shown in FIGS. 1 and 2, a jet conduit 16 is formed extending from an outer surface of the bowl 8 of the toilet main body 4 to the bottom portion. A downstream side of the jet conduit 16 faces an inlet 12*a* of the water discharge trap 12 at the bottom portion of the bowl 8, and a jet spout port 16*a* is provided on a downstream end of the jet conduit 16. Furthermore, a jet-side water supply channel 2*b* of the flush water supply device 6, of which more later, is provided on an upstream side of the jet conduit 16 of the toilet main body 4. Flush water that is supplied from the jet-side water supply channel 2*b* to the jet conduit 16 of the toilet main body 4 is discharged from the jet spout port 16*a* toward the water discharge trap 12, and jet spouting is thus performed. Now, as shown in FIG. 1, an upstream side of the rim-side water supply channel 2*a* of the flush water supply device 6 is connected to a switching valve 18 (of which more later) at a branch part B on the main water passageway 2. For its part, an upstream side of the jet-side water supply channel 2*b* of the flush water supply device 6 is connected to a pressure pump 22 (of which more later) of the flush water supply device 6 provided on a downstream side of a storage tank 20 of the flush water supply device 6, as shown in FIG. 1.

Next, the water discharge trap 12 of the toilet main body 4 includes the inlet 12*a* provided at the bottom portion of the bowl 8, an ascending pipe 12*b* that ascends from the inlet 12*a*, and a descending pipe 12*c* that descends from the ascending pipe 12*b*, and a part between the ascending pipe 12*b* and the descending pipe 12*c* is a top portion 12*d*. Also, as shown in FIG. 1, an outlet 12*e* of the descending pipe 12*c* of the water discharge trap 12 is connected to an inlet of a discharge socket S that is disposed behind and below the toilet main body 4. Furthermore, as shown in FIG. 1, an outlet of the discharge socket S on the rear side is connected to an inlet of a drain pipe D extending from a wall (not shown) on the rear side of the toilet main body 4. Consequently, a so-called water discharge mode of "wall side water discharge" is formed where water discharged through the outlet 12*e* of the water discharge trap 12 of the toilet main body 4 is discharged from the discharge socket S to the drain pipe D on a wall side. Additionally, the flush toilet 1 of the present embodiment is not limited to this water discharge mode of "wall side water discharge", and is applicable to a so-called water discharge mode of "floor side water discharge" where water discharged through the outlet 12*e* of the water discharge trap 12 of the toilet main body 4 is discharged from the discharge socket S to a drain pipe provided below an installation surface (floor F) of a bottom surface of the toilet main body 4.

Next, each configuration of the flush water supply device 6 of the flush toilet 1 according to the present embodiment will be schematically described with reference to FIG. 1. First, as shown in FIG. 1, the flush water supply device 6 includes, from an upstream side to a downstream side of the main water passageway 2, a stop cock 24, splitter hardware 26, a valve unit 28, and the switching valve 18. Next, the valve unit 28 includes a constant flow valve 30, a diaphragm main valve 32, and an electromagnetic valve 34 such as a solenoid valve. Furthermore, the flush water supply device 6 includes a controller 36. The controller 36 is capable of functioning as a controller that controls an opening-closing operation of an on-off valve (the electromagnetic valve 34) of the valve unit 28, a switching operation of the switching valve 18, and a rotational speed, an operation time, and the like of the pressure pump 22.

Moreover, the constant flow valve 30 of the valve unit 28 is for reducing flush water passing from the stop cock 24 on the main water passageway 2 and through the splitter hardware 26 to or below a predetermined flow rate. Additionally, in a mode where the flush toilet 1 is provided with a private part washing device (not shown), a water supply pipe (not shown) for supplying flush water to the private part washing device (not shown) may also be connected to the splitter hardware 26. Furthermore, at the valve unit 28, when an opening operation is performed on the electromagnetic valve 34 by the controller 36, the main valve 32 is opened, and flush water passing from the constant flow valve 30 and through the main valve 32 is supplied to the switching valve 18 at the branch part B on the downstream side of the main water passageway 2. The switching valve 18 is capable of supplying flush water from the main water passageway 2 to the rim-side water supply channel 2*a* and a tank-side water supply channel 2*c* at a same timing, and a ratio between water supplied to the rim side and water supplied to the tank side may be freely changed.

Next, the flush water supply device 6 includes a tank device T that enables flush water supplied from the main water passageway 2 to be supplied to the toilet main body 4. The tank device T includes the storage tank 20 that is coupled to a rear side of the toilet main body 4 and that is for storing flush water supplied from the main water passageway 2, and the pump (the pressure pump 22) for feeding the flush water in the storage tank 20 to the toilet main body 4 under pressure. Furthermore, the rim-side water supply channel 2*a* that communicates with the rim conduit 14 of the toilet main body 4, and the tank-side water supply channel 2*c* that is connected to the storage tank 20 are provided on the downstream side of the branch part B on the downstream side of the main water passageway 2. Accordingly, flush water that is supplied from the main water supply source WO to the branch part B of the main water passageway 2 is used as water to be supplied to at least one of the rim-side water supply channel 2*a* to be supplied to the rim and the tank-side water supply channel 2*c* to be supplied to the tank.

Furthermore, the flush water supply device 6 includes a pump water supply channel 2*d* that extends from a downstream side of the tank-side water supply channel 2*c* to the pressure pump 22, and the jet-side water supply channel 2*b* that extends on a downstream side from the pressure pump 22. Accordingly, with the flush toilet 1 of the present embodiment, flush water that is supplied from the main water passageway 2 and that is directly under tap water pressure may be supplied from the rim-side water supply channel 2*a* of the flush water supply device 6 to the rim spout port 14*a*, via the rim conduit 14 of the toilet main body 4, and water may thus be spouted from the rim spout port 14*a* (so-called "rim spouting"). Furthermore, the flush water supplied from the main water passageway 2 to the flush water supply device 6 may flow through the tank-side water supply channel 2*c*, the storage tank 20, the pump water supply channel 2*d* and the pressure pump 22 of the flush water supply device 6 and then be supplied from the jet-side water supply channel 2*b* to the jet spout port 16*a*, via the jet conduit 16 of the toilet main body 4, and water may thus be spouted from the jet spout port 16*a* (so-called "jet spouting"). That is, the flush toilet 1 of the present embodiment may function as a so-called hybrid flush toilet 1 that is capable of using, in combination, rim spouting that uses flush water that is supplied from the main water passageway 2 and that is directly under tap water pressure, and jet spouting that uses flush water that is from the storage tank 20 and that is pressurized by the pressure pump 22.

Now, an upper float switch 38 and a lower float switch 40 are disposed inside the storage tank 20. A water level inside the storage tank 20 may be detected by these float switches 38, 40. For example, the upper float switch 38 is switched on when the water level inside the storage tank 20 reaches a predetermined water storage level, and the controller 36 detects an on state of the upper float switch 38 and causes the electromagnetic valve 34 to close. For its part, the lower float switch 40 is switched on when the water level inside the storage tank 20 falls to a predetermined water level below the predetermined water storage level that is detected by the upper float switch 38, and the controller 36 detects an on state of the lower float switch 40 and causes the pressure pump 22 to stop. Furthermore, the pressure pump 22 is for causing flush water stored in the storage tank 20 to be discharged from the jet spout port 16*a*, by suctioning the flush water into the pump water supply channel 2*d* and pressurizing the flush water in the pump water supply channel 2*d* into the jet-side water supply channel 2*b*.

With the structures described above, at a time of normal toilet flushing, the controller 36 detects an operation of a toilet flushing switch (not shown) by a user, for example, and causes the electromagnetic valve 34, the switching valve 18, and the pressure pump 22 to sequentially operate. Discharging of water from the rim spout port 14*a* and the jet spout port 16*a* is thus sequentially started, and flush water used to flush the bowl 8 is discharged from the water discharge trap 12, together with waste in the bowl 8. Furthermore, when flushing is over, the controller 36 opens the electromagnetic valve 34, and the switching valve 18 is switched to the tank-side water supply channel 2*c* side, and flush water in the main water passageway 2 is used to refill the storage tank 20. Then, when the water level inside the storage tank 20 rises and the upper float switch 38 detects a specified water storage amount, the controller 36 closes the electromagnetic valve 34, so that the main valve 32 closes the main water passageway 2, and supply of water is thereby stopped. Moreover, each unit of the flush water supply device 6 (control unit) is stored in a rear storage V0 (of which more later) in a region more rearward than the bowl 8 of the toilet main body 4.

Next, specific description will be given to the rear storage V0 where the flush water supply device 6 (control unit) is stored in the toilet main body 4 of the flush toilet 1 according to the present embodiment, and a peripheral structure of the rear storage V0 with reference to FIGS. 2 to 7. Here, the flush toilet 1 of the present embodiment shown in FIGS. 4 to 7 does not show the flush water supply device 6.

First, as shown in FIGS. 2 to 7, the toilet main body 4 includes a skirt 42 formed on an outer side than a side surface of each of the bowl 8 and the water discharge trap 12. Also, the rear storage V0 of the toilet main body 4 is provided below an upper end of the skirt 42 and on an inner side than the skirt 42 in the region more rearward than the bowl 8 of the toilet main body 4, to form a storage region that can store at least a part of the flush water supply device 6 (control unit).

Figure 4:
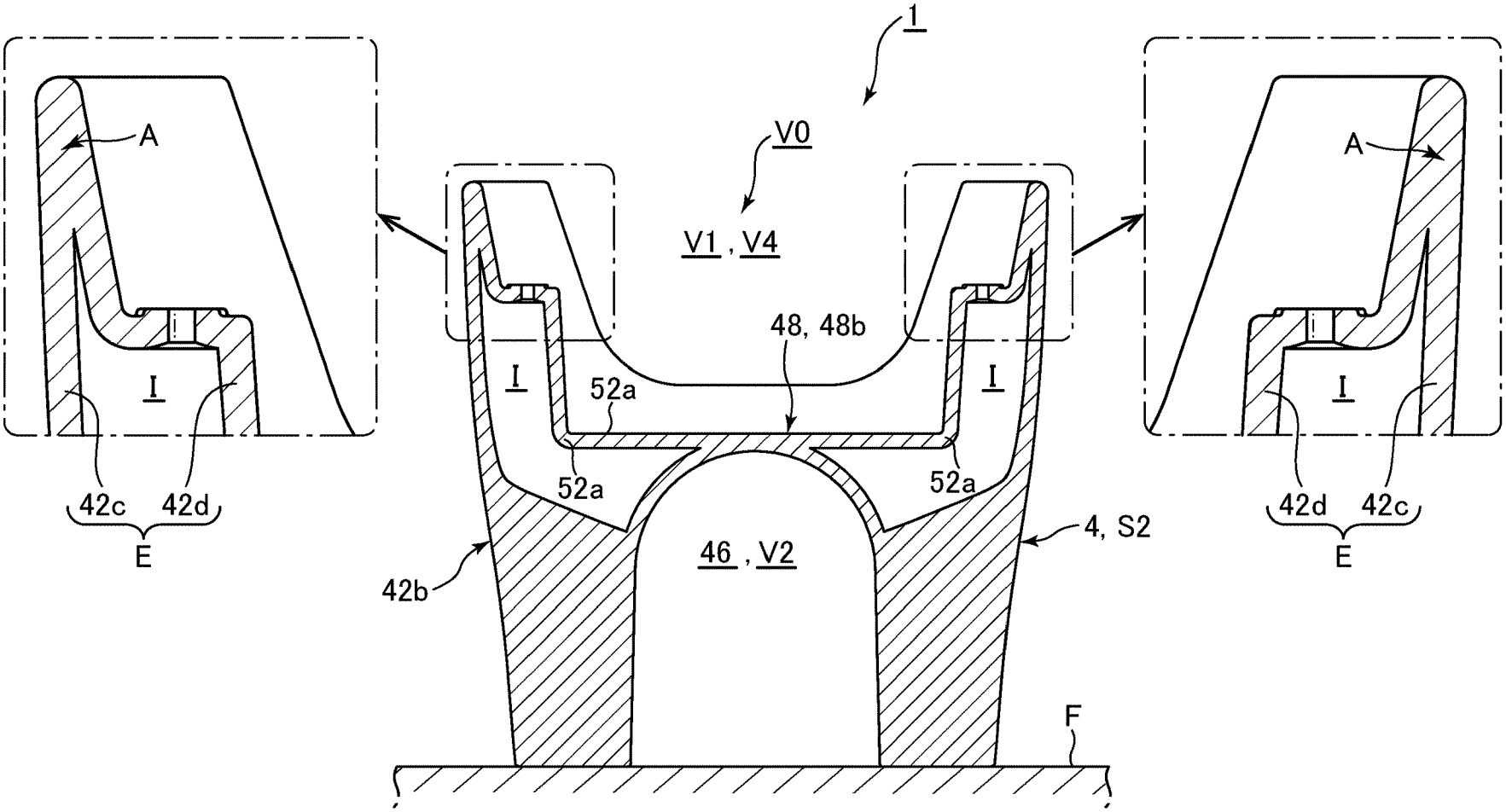
FIG. 4 is a cross-sectional view taken along a line IV-IV of FIG. 2.
Figure 5:
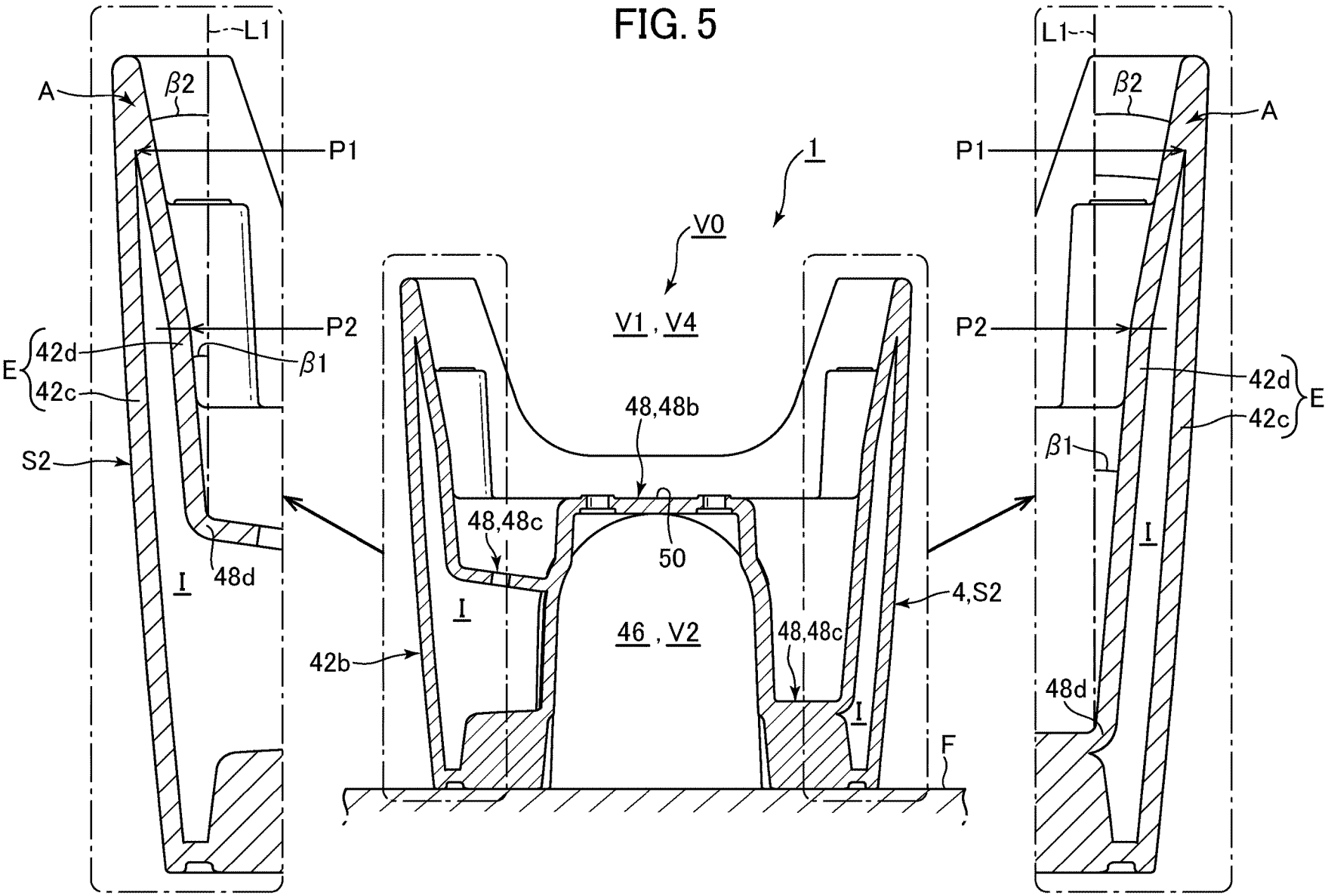
FIG. 5 is a cross-sectional view taken along a line V-V of FIG. 2.
Figure 6:
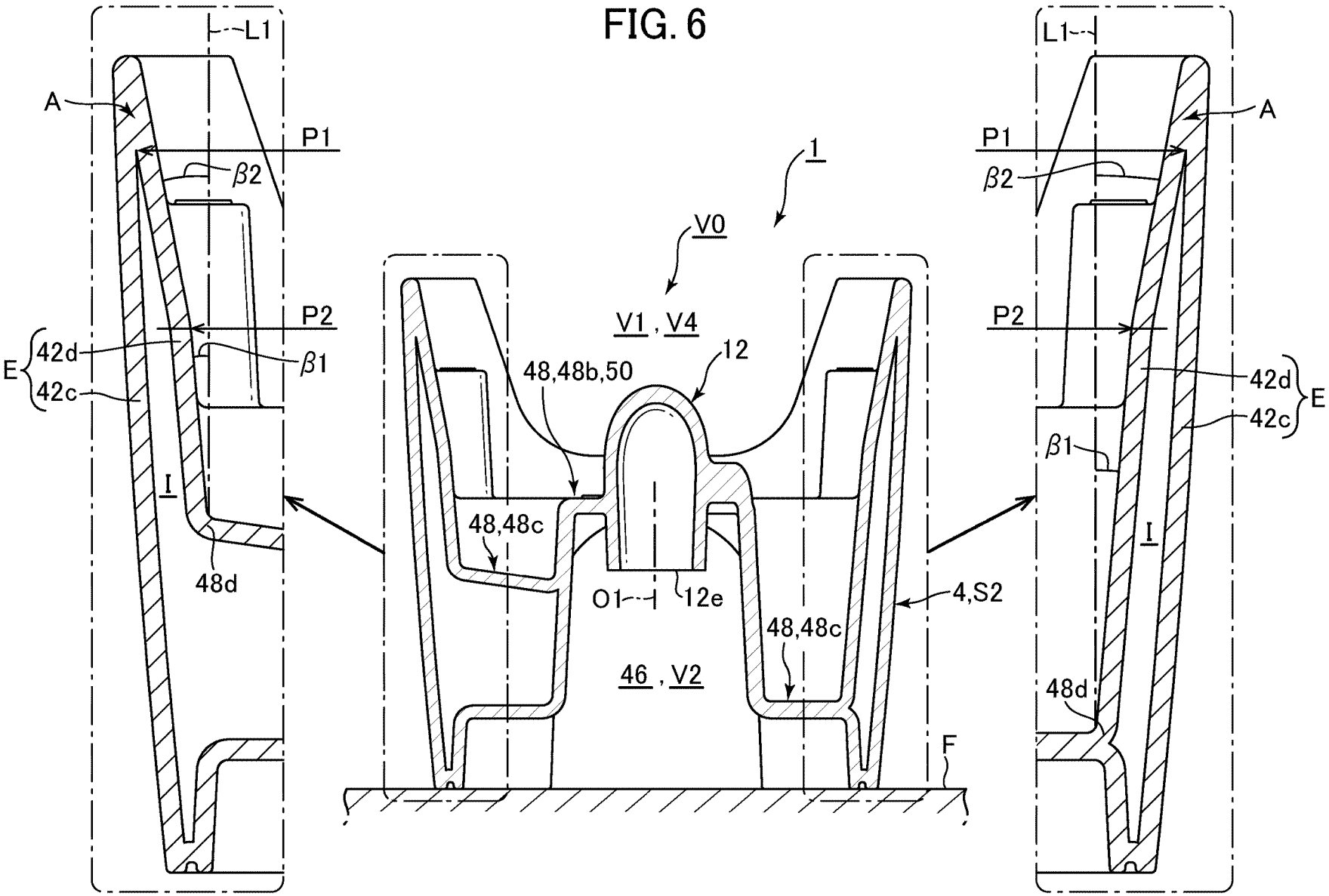
FIG. 6 is a cross-sectional view taken along a line VI-VI of FIG. 2.

Next, as shown in FIGS. 2 to 7, the skirt 42 includes a rear wall 42*a* provided on a back surface of the toilet main body 4, and a side wall 42*b* provided on each of left and right side surfaces of the toilet main body 4 seen from front. Here, as shown in FIGS. 5 to 7, each of the rear wall 42*a* and the side wall 42*b* of the skirt 42 includes an outer wall 42*c* that forms an outer surface of the skirt 42, and an inner wall 42*d* provided inside the outer wall 42*c*. The outer wall 42*c* and the inner wall 42*d* form a double wall E. Also, the double wall E forms an internal space I between the outer wall 42*c* and the inner wall 42*d*.

Also, an opening 44 to which the drain pipe D is connected is formed to penetrate, in a front-rear direction, a lower portion of a center in a left-right direction seen from front in the rear wall 42*a* of the skirt 42. Furthermore, as shown in FIGS. 4 to 7, a discharge socket storage 46 is formed on a front side of the opening 44 in a lower region of a center of the rear storage V0 in the left-right direction in the toilet main body 4. The discharge socket storage 46 functions as a storage region that can store the discharge socket S (see FIG. 1) connected to the outlet 12*e* of the descending pipe 12*c* of the water discharge trap 12.

Next, as shown in FIGS. 5 to 7, the rear storage V0 includes a supporting wall 48 that supports the flush water supply device 6 (control unit). The supporting wall 48 is joined to the water discharge trap 12 and divides, in an up-down direction, a storage region of the rear storage V0 into an upper region V1 and a lower region V2. Also, the upper region V1 of the rear storage V0 includes a storage region that stores at least a part of the flush water supply device 6 (control unit), and the lower region V2 of the rear storage V0 includes an open region of each of the opening 44 and the discharge socket storage 46.

Next, as shown in FIGS. 2 and 5 to 7, the supporting wall 48 of the rear storage V0 includes a horizontal wall 48*b* that extends in a horizontal direction leftward, rightward and rearward from a joining portion 48*a* to the water discharge trap 12. Also, the supporting wall 48 includes a lower wall 48*c* provided outside and below the horizontal wall 48*b* in the left-right direction. An outer side of the lower wall 48*c* in the left-right direction is joined to the inner wall 42*d* of the double wall E in each of the left and right side walls 42*b* of the skirt 42.

Next, as shown in FIGS. 2 and 4 to 7, the horizontal wall 48*b* of the supporting wall 48 of the rear storage V0 includes a horizontal main wall 50 provided to extend rearward from behind a discharge core O1 in the water discharge trap 12. Furthermore, the horizontal wall 48*b* of the supporting wall 48 of the rear storage V0 includes a horizontal auxiliary wall 52 that is provided on a rear side of the horizontal main wall 50 and that is joined to the rear wall 42*a* of the skirt 42.

Also, as shown in FIGS. 2 and 5 to 7, each of left and right side end portions 50*a* of the horizontal main wall 50 is provided away from each of the left and right side walls 42*b* of the skirt 42 in the left-right direction. For its part, as shown in FIGS. 2 and 4, a rear end portion of the horizontal auxiliary wall 52 is joined to the rear wall 42*a* of the skirt 42. Also, each of left and right side end portions 52*a* of the horizontal auxiliary wall 52 is provided to be joined to each of the left and right side walls 42*b* of the skirt 42 in the left-right direction. Consequently, in plan view shown in FIG. 2, the horizontal wall 48*b* of the supporting wall 48 forms a substantially T-shape together with the horizontal main wall 50 extending in the front-rear direction and the horizontal auxiliary wall 52 extending in the left-right direction.

Next, as shown in FIGS. 2 and 4, the left and right side end portions 52*a* of the horizontal auxiliary wall 52 on the rear side in the horizontal wall 48*b* of the supporting wall 48 are joining portions that are joined to the inner walls 42*d* of the double walls E in the left and right side walls 42*b* of the skirt 42, respectively. Also, as shown in FIGS. 2 and 5 to 7, an outer end portion 48*d* of the lower wall 48*c* of the supporting wall 48 in the left-right direction is a joining portion that is joined to the inner wall 42*d* of the double wall E in each of the left and right side walls 42*b* of the skirt 42. Further, as shown in FIGS. 2 and 4 to 6, the skirt 42 includes a single wall A in which the internal space I of the double wall E is removed, in an upper end above the joining portions 48*d* and 52*a* between the double wall E and the supporting wall 48.

Next, as shown in FIGS. 2 and 7, the side wall 42*b* of the skirt 42 includes a first skirt S1 formed by the double wall E from a lower end to an upper end of the side wall. Also, as shown in FIG. 2, the first skirt S1 is joined to a joining portion C1 where the bowl 8 of the toilet main body 4 and the rear storage V0 are joined. Further, as shown in FIGS. 2 and 4 to 6, the side wall 42*b* of the skirt 42 includes a second skirt S2 provided on a rear side of the first skirt S1. The second skirt S2 is formed by the double wall E from a lower end of the skirt to a predetermined upper position P1 and is formed by the single wall A from the predetermined upper position P1 to the upper end of the skirt 42.

Next, as shown in FIGS. 2 and 4 to 7, the upper region V1 of the rear storage V0 includes the joining portion C1 between the bowl 8 of the toilet main body 4 and the rear storage V0, and a joining portion C2 between the water discharge trap 12 and the supporting wall 48, and the upper region also includes a front region V3 disposed more forward than the discharge core O1 that is a center of a conduit on an outlet 12*e* side of the water discharge trap 12. Also, the upper region V1 of the rear storage V0 includes a rear region V4 disposed on a rear side of the front region V3. Further, the double wall E of the first skirt S1 is provided in the front region V3 of the rear storage V0. Additionally, the single wall A of the second skirt S2 is provided in the rear region V4 of the rear storage V0.

Next, as shown in FIG. 7, the double wall E of the first skirt S1 slopes at a substantially constant slope angle $\alpha 1$ to a vertical face L1 in such a manner that a wall surface of the inner wall 42*d* of the double wall spreads outward from below toward above the rear storage V0. Also, as shown in FIGS. 5 and 6, the second skirt S2 slopes in two stages in such a manner that the wall surface of the inner wall 42*d* of the double wall E of the second skirt spreads outward from bottom to top.

Furthermore, as shown in FIGS. 5 and 6, the second skirt S2 slopes, in a first slope stage, at a first slope angle $\beta 1$ that is identical to a slope angle $\alpha 1$ ($\alpha 1=\beta 1$) of the inner wall 42*d* of the first skirt S1 to the vertical face L1 in such a manner that the wall surface of the inner wall 42*d* of the double wall E spreads outward from the lower joining portion 48*d* to the lower wall 48*c* of the supporting wall 48 toward an upper deflection position P2. Afterward, the second skirt S2 slopes, in a second slope stage, at a second slope angle $\beta 2$ that is larger than the first slope angle $\beta 1$ to the vertical face L1 ($\beta 1<\beta 2$) in such a manner that the second skirt S2 spreads outward from the deflection position P2 toward the upper single wall A.

Next, description will be given to operation of the flush toilet 1 according to the above embodiment of the present invention with reference to FIGS. 1 to 7. First, according to the flush toilet 1 of the embodiment of the present invention, the supporting wall 48 that divides the storage region of the rear storage V0 into the upper and lower regions (the upper region V1 and the lower region V2) and that supports the control unit (flush water supply device 6) is joined to and supported by the double wall E of the side wall 42*b* of the skirt 42, so that the supporting wall 48 and the skirt 42 can improve strength each other. Also, in the skirt 42, the upper end above the joining portion 48*d* between the double wall E and the supporting wall 48 includes the single wall A in which the internal space I of the double wall E is removed. Consequently, the larger storage region in the rear storage V0 can be acquired, while maintaining the strength of the rear storage V0 from the joining portion 48*d* between the double wall E in the side wall 42*b* of the skirt 42 and the supporting wall 48 to the upper end above the joining portion. Therefore, the large storage region of the control unit (flush water supply device 6) in the toilet main body 4 can be acquired, and the strength of the whole toilet main body 4 can be increased, while suppressing an external dimension of the whole toilet main body 4.

Next, according to the flush toilet 1 of the present embodiment, for example, when an entire region above the joining portion 48*d* between the skirt 42 and the supporting wall 48 is set to the single wall A, the larger storage region in the rear storage V0 can be acquired, but there is a problem that deformation such as distortion of a part of the single wall A of the skirt 42 is likely to occur due to insufficient strength during manufacturing. Consequently, in the flush toilet 1 of the present embodiment, the first skirt S1 that is formed by the double wall E from the lower end to the upper end of the side wall 42*b* of the skirt 42 can be combined with the second skirt S2 that is formed by the double wall E from the lower end of the side wall 42*b* of the skirt 42 to the predetermined upper position P1 and that is formed by the single wall A from the predetermined upper position P1 to the upper end of the side wall 42*b* of the skirt 42. Consequently, the deformation, such as the distortion, of the double wall E or the single wall A of the side wall 42*b* of the skirt 42 during the manufacturing can be inhibited, and the larger storage region in the rear storage V0 can be acquired while eliminating lack of strength.

Also, according to the flush toilet 1 of the present embodiment, generally, the joining portion C1 where the bowl 8 of the toilet main body 4 made of ceramic and the rear storage V0 are joined is a portion to which load such as stress concentration is likely to be applied due to a weight of the bowl 8 itself, a weight of the control unit (flush water supply device 6) stored in the rear storage V0 or the like. Therefore, also during the manufacturing, the transport, or the like of the toilet main body 4, when load such as internal force or external force to the toilet main body 4 acts on portions such as the joining portion C1 between the bowl 8 and the rear storage V0, the toilet main body 4 might be damaged. To solve the problem, in the flush toilet 1 of the present embodiment, the first skirt S1 that is formed by the double wall E from the lower end to the upper end of the side wall 42*b* of the skirt 42 is joined to the joining portion C1 between the bowl 8 of the toilet main body 4 and the rear storage V0, so that strength of the joining portion C1 between the bowl 8 and the rear storage V0 can be increased by the double wall E of the first skirt S1. Therefore, also in the rear storage V0 of the toilet main body 4, the larger storage region can be acquired, while eliminating lack of strength.

Furthermore, according to the flush toilet 1 of the present embodiment, the double wall E of the first skirt S1 is provided in the front region V3 of the rear storage V0 that includes the joining portion C1 between the bowl 8 of the toilet main body 4 and the rear storage V0, and the joining portion C2 between the water discharge trap 12 and the supporting wall 48, the front region being disposed more forward than the discharge core O1 that is the center of the conduit on the outlet 12*e* side of the water discharge trap 12. Consequently, the double wall E of the first skirt S1 can support the joining portion C1 between the bowl 8 of the toilet main body 4 and the front region V3 of the rear storage V0, and the double wall E of the first skirt S1 can also support the supporting wall 48 that supports the water discharge trap 12. Therefore, the double wall E can increase strength of the first skirt part S1 itself in the front region V3 of the rear storage V0, and a supporting force of the first skirt S1 that supports the joining portion C1 between the bowl 8 and the rear storage V0 can be reinforced. Also, the strength of the first skirt S1 itself in the front region V3 of the rear storage V0 can be reinforced by the double wall E, and hence a supporting force of the first skirt S1 that supports the water discharge trap 12 via the supporting wall 48 can be reinforced. Furthermore, for the first skirt S1 in the front region V3 of the rear storage V0 that includes the joining portion C1 to the bowl 8 and the joining portion C2 between the water discharge trap 12 and the supporting wall 48, a structure of the double wall E can provide a structure that is thicker than a structure of the single wall A of the second skirt S2 in the rear region V4 of the rear storage V0. Consequently, when the toilet main body 4 is moved during the transport or during the construction, the operator can easily hold the structural portion of the double wall E of the first skirt S1 that is thicker than the single wall A of the second skirt S2, so that the single wall A of the second skirt S2 having lower strength than the structural portion of the double wall E of the first skirt S1 can be inhibited from being held.

Also, according to the flush toilet 1 of the present embodiment, the first skirt S1 slopes at the substantially constant slope angle α1 to the vertical face L1 in such a manner that the wall surface of the inner wall 42*d* of the double wall E spreads outward from below toward above the rear storage V0, so that deformation such as distortion can be unlikely to occur. Furthermore, the second skirt S2 slopes in two stages in such a manner that the wall surface of the inner wall 42*d* of the double wall E of the second skirt spreads outward from bottom to top, so that a larger storage region in the rear storage V0 can be acquired. Additionally, the wall surface with the constant slope angle α1 in the inner wall 42*d* of the double wall E of the first skirt S1 and the wall surface sloping in two stages in the inner wall 42*d* of the double wall E of the second skirt S2 can increase a difference in thickness between a structural portion of the double wall E of the first skirt S1 and a structural portion of the single wall A of the second skirt S2. Therefore, when moving the toilet main body 4 during the transport or during the construction, the operator can easily hold the structural portion of the double wall E of the first skirt S1 that is thicker than the single wall A of the second skirt S2, so that the single wall A of the second skirt S2 having a lower strength than the structural portion of the double wall E of the first skirt S1 can be inhibited from being held.

According to the flush toilet 1 of the present embodiment, the second skirt S2 slopes, in the first slope stage, at the first slope angle β1 that is identical to the slope angle α1 of the inner wall 42*d* of the first skirt S1 in such a manner that the wall surface of the inner wall 42*d* of the double wall E spreads outward from the lower joining portion 48*d* to the supporting wall 48 toward the upper deflection position P2, and the slope of the double wall E is identical to that of the single wall A in the first slope stage. Consequently, in a region of the wall surface of the inner wall 42*d* of the double wall E of the second skirt S2 from the lower joining portion 48*d* to the supporting wall 48 to the upper deflection position P2, the wall surfaces of the inner walls 42*d* of the double walls E of the first skirt S1 and the second skirt S2 are formed smoothly without mutual steps. Therefore, also in each of the first skirt S1 and the second skirt S2 in a vicinity of the joining portion 48*d* to the supporting wall 48, deformation such as distortion due to the mutual steps is unlikely to occur, and lack of strength in the rear storage V0 can be suppressed. Then, the second skirt S2 slopes, in the second slope stage, at the second slope angle β2 that is larger than the first slope angle β1 to spread outward from the deflection position P2 of the inner wall 42*d* of the double wall E toward the upper single wall A, so that the slope of the second skirt S2 at the second slope angle β2 in the second slope stage can be formed in a shape that spreads outward from a base end of the deflection position P2 of the double wall E toward the upper single wall A. Consequently, the larger storage region in the rear storage V0 can be acquired, while suppressing the lack of strength of a transition portion that transits from the double wall E to the single wall A, in the second slope stage of the second skirt S2.

Although the present disclosure has been explained with reference to specific, preferred embodiments, one of ordinary skill in the art will recognize that modifications and improvements can be made while remaining within the scope and spirit of the present disclosure. The scope of the present disclosure is determined solely by appended claims.

What is claimed is:

1. A flush toilet comprising:

a toilet main body made of ceramics, the toilet main body including a bowl configured to receive waste, and a water discharge trap configured to discharge waste in the bowl, the water discharge trap including an inlet connected to a lower portion of the bowl, and a control unit provided more rearward than the bowl of the toilet main body, the control unit being configured to control discharge and stopping of flush water to the bowl, wherein the toilet main body further includes a skirt and a rear storage configured to store at least a part of the control unit, the skirt being formed on an outer side of side surfaces of the bowl and the water discharge trap, and a rear storage being provided below an upper end of the skirt and on an inner side than the skirt in a region more rearward than the bowl, the rear storage includes a supporting wall configured to support the control unit so as to divide a storage region into upper and lower regions, the skirt forms a double wall including an outer wall and an inner wall, the outer wall forms an outer surface, the inner wall is provided inside the outer wall, and at least a part of the double wall forms an internal space between the outer wall and the inner wall, the supporting wall is supported by being joined to the double wall of the skirt, and the skirt includes a single wall in which the internal space of the double wall is removed in an upper end above a joining portion between the double wall and the supporting wall, and wherein the skirt includes a first skirt formed by the double wall from a lower end to an upper end of the skirt, and a second skirt formed by the double wall from the lower end of the skirt to a predetermined upper position, the second skirt being formed by the single wall from the predetermined upper position to the upper end of the skirt.

2. The flush toilet according to claim 1, wherein the first skirt is provided in a joining portion where the bowl of the toilet main body and the rear storage are joined.

3. The flush toilet according to claim 2, wherein the rear storage includes:

a front region including the joining portion between the bowl of the toilet main body and the rear storage, and a joining portion between the water discharge trap and the supporting wall, the front region being disposed more forward than a discharge core that is a center of an outlet side conduit of the water discharge trap, and a rear region disposed on a rear side of the front region, the double wall of the first skirt is provided in the front region of the rear storage, and the single wall of the second skirt is provided in the rear region of the rear storage.

4. The flush toilet according to claim 1, wherein the double wall of the first skirt slopes at a substantially constant slope angle in such a manner that a wall surface of the inner wall of the double wall spreads outward from below toward above the rear storage, and the second skirt slopes in two stages in such a manner that the wall surface of the inner wall of the double wall of the second skirt spreads outward from bottom to top.

5. The flush toilet according to claim 4, wherein the second skirt slopes at a first slope angle in a first slope stage, the first slope angle being identical to the substaintially constant slope angle of the inner wall of the first skirt in such a manner that the wall surface of the inner wall of the double wall spreads outward from a lower joining portion to the supporting wall toward an upper deflection position, and then the second skirt slopes at a second slope angle in a second slope stage, the second slope angle being larger than the first slope angle to spread outward from the upper deflection position toward the single wall.

* * * * *